US005243125A

United States Patent [19]

Yamaguchi

[11] Patent Number: 5,243,125

[45] Date of Patent: Sep. 7, 1993

[54] KEYBOARD APPARATUS FOR ELECTRONIC MUSICAL INSTRUMENT HAVING COOPERATING JACKS AND HAMMERS

[75] Inventor: Tsutomu Yamaguchi, Hamamatsu, Japan

[73] Assignee: Kabushiki Kaisha Kawai Gakki Seisakusho, Shizuoka, Japan

[21] Appl. No.: 851,696

[22] Filed: Mar. 13, 1992

[30] Foreign Application Priority Data

Mar. 22, 1991 [JP] Japan ..... 3-017546[U]
Apr. 17, 1991 [JP] Japan ..... 3-025872[U]

[51] Int. Cl.[5] ..... G10H 3/10; G10H 1/34
[52] U.S. Cl. ..... 84/745; 84/DIG. 7
[58] Field of Search ..... 84/423 R, 723, 744, 84/745, DIG. 7

[56] References Cited

U.S. PATENT DOCUMENTS

| | | | |
|---|---|---|---|
| 3,735,076 | 5/1973 | Iijima . | |
| 4,058,044 | 11/1977 | Murakami | 84/403 X |
| 4,168,649 | 9/1979 | Goldenberg | 84/423 X |
| 4,723,471 | 2/1988 | Sugimoto . | |
| 4,901,614 | 2/1990 | Kumano et al. | 84/DIG. 7 X |
| 4,993,305 | 2/1991 | Franz et al. . | |
| 5,003,859 | 4/1991 | Monte et al. | 84/423 R |
| 5,062,342 | 11/1991 | Nagatsuma | 84/744 |
| 5,079,985 | 1/1992 | Yamaguchi et al. | 84/DIG. 7 X |

FOREIGN PATENT DOCUMENTS 63-155095 6/1988 Japan .

*Primary Examiner*—William M. Shoop, Jr.
*Assistant Examiner*—Jeffrey W. Donels
*Attorney, Agent, or Firm*—Armstrong, Westerman, Hattori, McLeland & Naughton

[57] ABSTRACT

In a keyboard apparatus for an electronic musical instrument having jacks and hammers, each jack is rotatable by a force to be transmitted from a key when the key is depressed, and each of the hammers is rotatable by a force to be transmitted from the rotatable jack. Respective jack is rotatably disposed relative to the respective key by fitting a first supporting shaft formed in the respective jack into a first bearing recess formed in the respective key. Respective hammer is rotatably disposed in a keyboard chassis by fitting a second supporting shaft formed in one of the keyboard chassis and the respective hammer into a second bearing recess formed in the other of the keyboard chassis and the respective hammer. A resilient member is disposed between the respective hammer and the respective jack by engaging one end and the other end of the resilient member with the hammer and the jack, respectively, such that the first supporting shaft and the first bearing recess and the second supporting shaft and the second bearing recess are respectively pressingly held together and that the respective key and the respective jack are returned to their respective original positions.

4 Claims, 4 Drawing Sheets

KEYBOARD APPARATUS FOR ELECTRONIC MUSICAL INSTRUMENT HAVING COOPERATING JACKS AND HAMMERS

BACKGROUND OF THE INVENTION

This invention relates to a keyboard apparatus for an electronic musical instrument, particularly an electronic piano.

A conventional electronic piano comprises jacks and hammers, each being rotatably supported by a shaft and a complete bearing. It is thus so arranged that each jack is returned to its original position by means of a spring and that each hammer is returned to its original position by its own weight.

In addition, the conventional electronic piano has the following arrangement. Namely, a first switch portion and a second switch portion of each of keyboard switches are sequentially operated or actuated by an actuator provided on a key so that a sound is generated in a sound volume depending on the time from the actuation of the first switch portion to the actuation of the second switch portion.

According to the above-mentioned conventional arrangement of the electronic piano, there is a disadvantage in that the number of assembling steps is large because the jacks and the hammers are rotatably supported by shafts and complete bearings.

In addition, according to the above-mentioned arrangement of the conventional electronic piano, since the keyboard switches have dimensional errors in manufacturing, when an attempt is made to stabilize the sound volume corresponding to the velocity of depressing the key, the difference in stroke between the first switch portion and the second switch portion of the keyboard switch at the front of the key cannot be made narrower than a certain value, but has to be kept large. As a consequence, the conventional electronic piano has a poor performance or efficiency in depressing a key in rapid succession (hereinafter called "a rapid successive key depression efficiency"). In addition, it has a disadvantage in that it is difficult to generate a sound in a light-depression playing, i.e., by playing the electronic piano in such a way of piano playing as depressing the key half way down first, followed by its further depression.

OBJECT AND SUMMARY OF THE INVENTION

Taking the above disadvantages into consideration, this invention has an object of providing a keyboard apparatus for an electronic musical instrument, in which apparatus such a feeling of touching the key as that of an acoustic piano can be obtained, assembling is easy, the number of parts is smaller, and the cost is low.

This invention has another object of providing a keyboard apparatus for an electronic musical instrument, in which apparatus the sound volume corresponding to the velocity of depressing the key can be stably obtained, as good a rapid successive key depression efficiency as that of the acoustic piano can be obtained, and a light-depression playing is possible.

In order to attain the above objects, a keyboard apparatus for an electronic musical instrument according to one aspect of this invention has jacks and hammers, each of the jacks being rotatable by a force to be transmitted from a key when the key is depressed, each of the hammers being rotatable by a force to be transmitted from the rotatable jack, wherein: the respective jack is rotatably disposed relative to the respective key by fitting a first supporting shaft formed in the respective jack into a first bearing recess formed in the respective key; the respective hammer is rotatably disposed in a keyboard chassis by fitting a second supporting shaft formed in one of the keyboard chassis and the respective hammer into a second bearing recess formed in the other of the keyboard chassis and the respective hammer; and a resilient member is provided between the respective hammer and the respective jack by engaging one end and the other end of the resilient member with the hammer and the jack, respectively, such that the first supporting shaft and the first bearing recess as well as the second supporting shaft and the second bearing recess are respectively urged together and that the respective key and the respective jack are returned to their respective original positions.

A keyboard apparatus for an electronic musical instrument according to another aspect of this invention is arranged that the respective jack is provided with an actuator for actuating keyboard switches and that the actuator sequentially actuates a first switch portion and a second switch portion of each of the keyboard switches.

According to the above-mentioned one aspect of this invention, the respective jack and the respective hammer are made to be rotatable relative to the key and the keyboard chassis, respectively, by the fitting of the supporting shafts into the bearing recesses. Further, since the first supporting shaft and the first bearing recess as well as the second supporting shaft and the second bearing recess are urged together by the resilient force of the resilient member which is engaged with the jack and the hammer at each end thereof, respectively, the jack and the hammer do not give rise to rattling relative to the key and the keyboard chassis, respectively, and the key and the jack can be returned to their respective original positions by the resilient force of the resilient member.

According to the above-mentioned other aspect of this invention, when the key is depressed by a predetermined amount first and then further downwards, the jack is caused to rotate by the force to be transmitted from the key. By this rotation the actuator which is provided in the jack sequentially actuates the first switch portion and the second switch portion of the keyboard switch. Since the movement of this actuator is larger than the movement of the key, the difference in the key stroke at the front end at which the first switch portion and the second switch portion of the keyboard switch are actuated, can be made remarkably smaller than the conventional one while the sound volume corresponding to the key depression velocity remains stabilized, even if a conventional keyboard switch is employed. Therefore, as good a rapid successive key depression efficiency as that of the acoustic piano can be obtained, and a light-depression playing is possible.

BRIEF DESCRIPTION OF THE DRAWINGS

The above and other objects and the attendant advantages of this invention will become readily apparent by reference to the following detailed description when considered in conjunction with the accompanying drawings wherein.

DETAILED DESCRIPTION OF PREFERRED EMBODIMENTS

An explanation will now be made about preferred embodiments of this invention by referring to the accompanied drawings.

Figure 1:
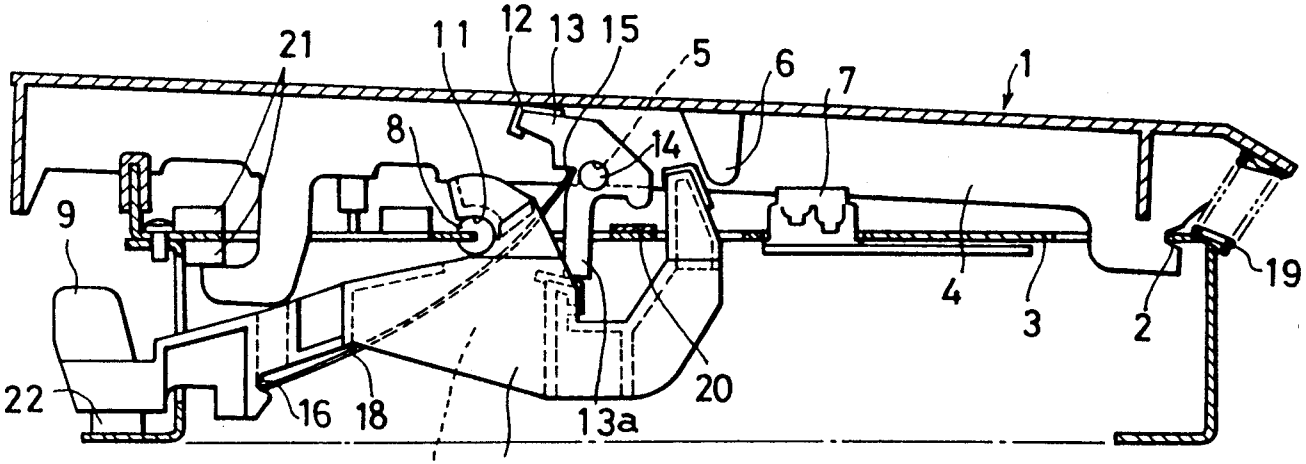
FIG. 1 is a side view, partly in section, of an embodiment of this invention apparatus in a condition in which the key is released.

FIG. 1 shows an embodiment of this invention in which a key is free from depression.

Figure 2:
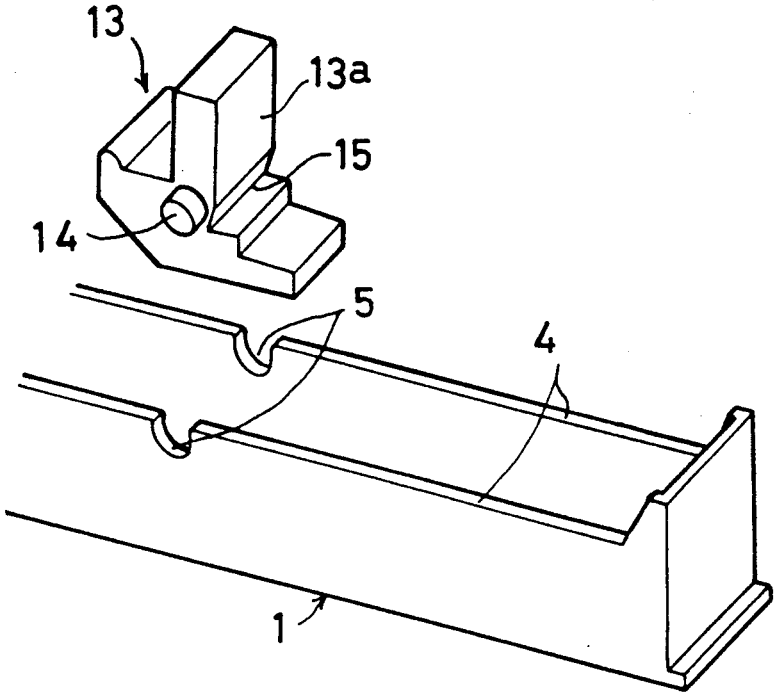
FIG. 2 is an exploded perspective view of a key and a jack of the apparatus shown in FIG. 1.
Figure 3:
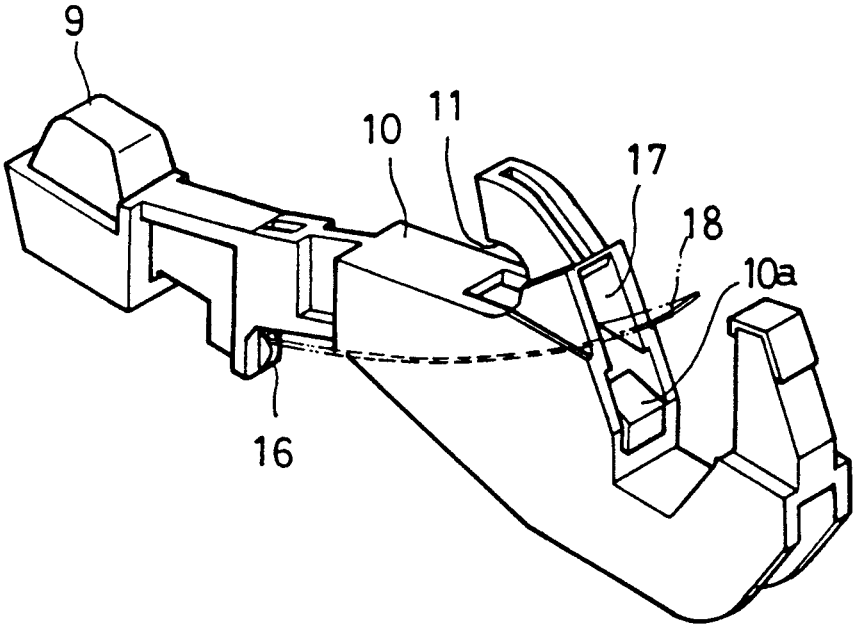
FIG. 3 is a perspective view of a hammer of the apparatus shown in FIG. 1.

In FIG. 1, each white key 1 is rotatably supported on a keyboard chassis 3 without giving rise to rattling, by engaging a bearing recess 2 at a rear end thereof with an edge portion of an opening in the keyboard chassis 3. On bottom edge portions of both side walls 4 of the key 1, there are formed bearing recesses 5 as shown in FIG. 2. On the bottom wall of the key 1 there is provided a catcher 6 in a projecting manner. On the keyboard chassis 3 there is provided a keyboard switch 7 for actuation by an actuator, not illustrated, of the white key 1. To a cylindrical supporting shaft 8 which is fitted into an edge portion of an opening in the keyboard chassis 3, there is fittingly engaged, as shown in FIG. 3, a bearing recess 11 of a hammer 10 to one end of which a weight 9 is fixed so that the hammer 10 is rotatable about the supporting shaft 8. In the above-mentioned bearing recesses 5 of the white key 1, there is fitted a supporting shaft 14 of a plate-like jack 13 which has a cushion material 12 attached to one end thereof. A plate spring 18 which passes through a cavity portion 17 of the hammer 10 is engaged, at one end thereof, with an engaging recess 15 of the jack 13 and, at the other end thereof, with an engaging recess 16 of the hammer 10. By the elastic force of the plate spring 18, the supporting shaft 14 of the jack 13 is urged against the bearing recess 5 and the bearing recess 11 of the hammer 10 is urged against the supporting shaft 8, respectively. In this manner, the jack 13 and the hammer 10 can be rotatably supported by the white key 1 and the keyboard chassis 3 without giving rise to rattling. The elastic force of this plate spring 18 urges the white key 1 through the jack 13 to return the white key 1 to its released position, i.e., its original position and, at the same time, operates to the hammer 10, together with its own weight, to return the hammer 10 to the position as shown in FIG. 1. In FIG. 1, numeral 19 denotes a load adjusting spring for the white key 1, numeral 20 denotes a key stopper and numeral 22 denotes a hammer stopper.

Figure 4:
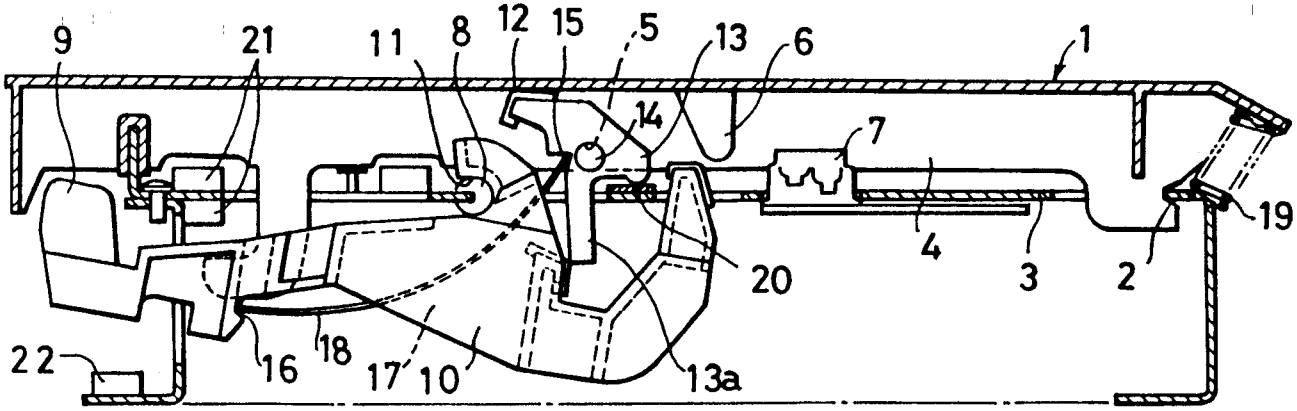
FIG. 4 is a side view, partly in section, of the apparatus shown in FIG. 1 in a condition in which the jack is ready to go out of engagement with a jack contact portion of the hammer at the time of key depression.
Figure 5:
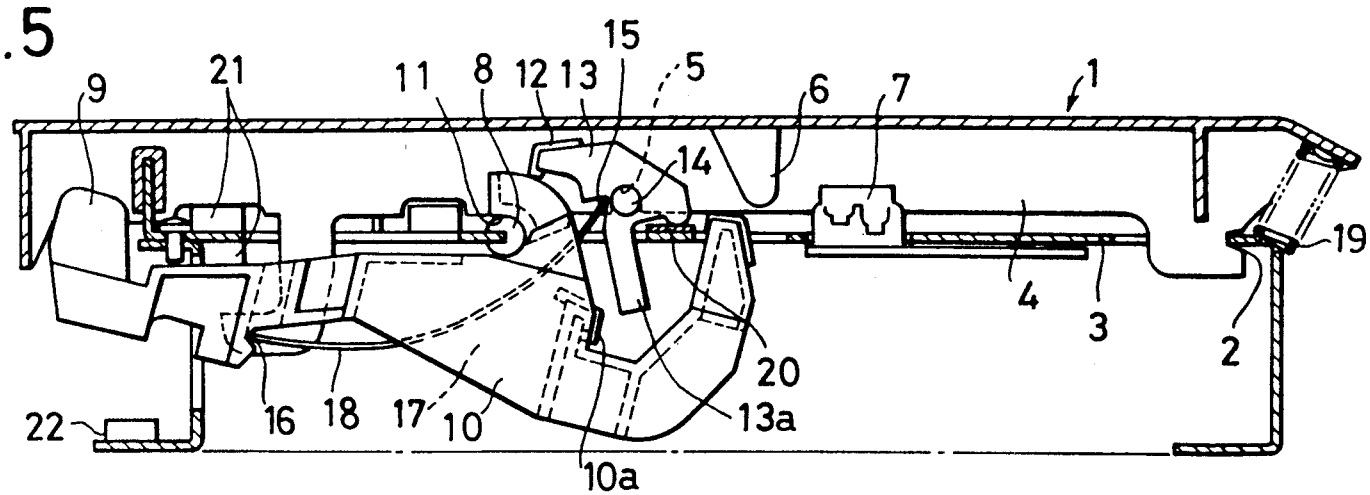
FIG. 5 is a side view, partly in section, of the apparatus shown in FIG. 1 in a condition in which the jack is away from the jack contact portion of the hammer at the time of key depression.
Figure 6:
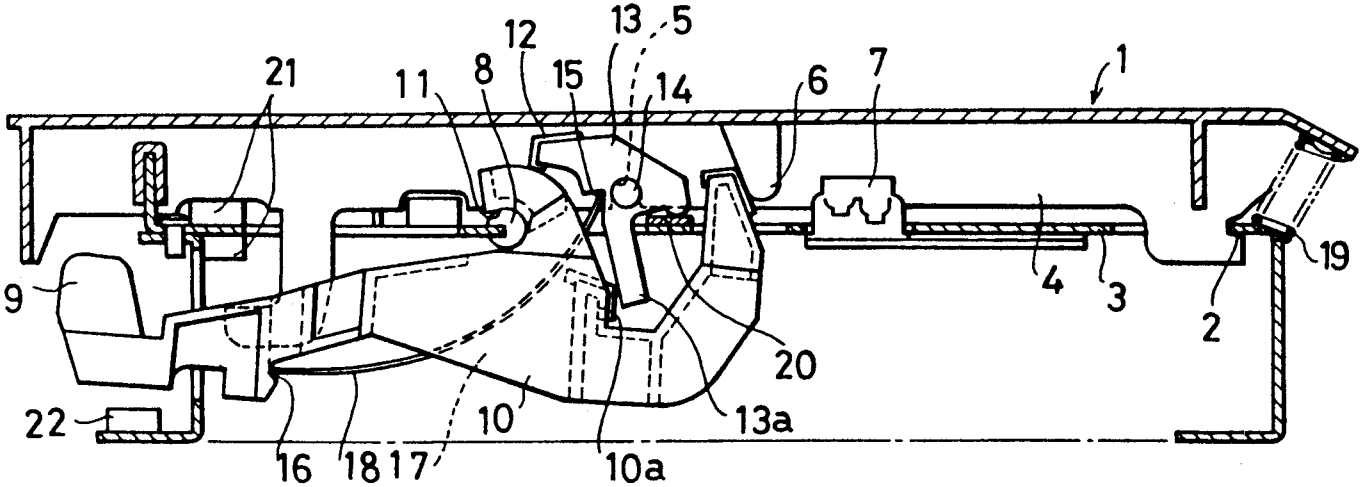
FIG. 6 is a side view, partly in section, of the apparatus shown in FIG. 1 in a condition in which the hammer is in abutment with a catcher at the time of key depression.

Next, the operation of this embodiment will be explained. When the white key 1 of released position as shown in FIG. 1 is depressed, the jack 13 moves downwards, and its pressing portion 13*a* urges that jack-contact portion 10*a* of the hammer 10 which contacts the pressing portion 13*a*. As shown in FIG. 4, when the jack 13 abuts the jack stopper 20, the jack 13 rotates, and the pressing portion 13*a* will come out of engagement with the jack-contact portion 10*a*. At this time of disengagement, a player can feel a touch of termination of key depression movement, which cannot be felt except at the time of weak hammering. Even after the jack 13 has become out of engagement with the hammer 10, the hammer 10 keeps on rotating by its inertia as shown in FIG. 5. Therefore, the player can feel a touch as if a hammer of an acoustic piano were striking a string. After the hammer 10 has stopped rotation, it rotates in the opposite direction by its own weight until it abuts the catcher 6 which is fixed to the white key 1, as shown in FIG. 6, thereby restricting the vibration of the hammer 10. When the player releases his or her finger off the white key 1, the hammer 10 returns to the position as shown in FIG. 1, and the pressing portion 13*a* of the jack 13 abuts the jack-contact portion 10*a* of the hammer 10.

In the above-mentioned embodiment, the supporting shaft 8 is provided in the keyboard chassis 3 and the bearing recess 11 is provided in the hammer 10. However, the supporting shaft may be provided in the hammer 10 and the bearing recess may be provided in the keyboard chassis 3.

Figure 7:
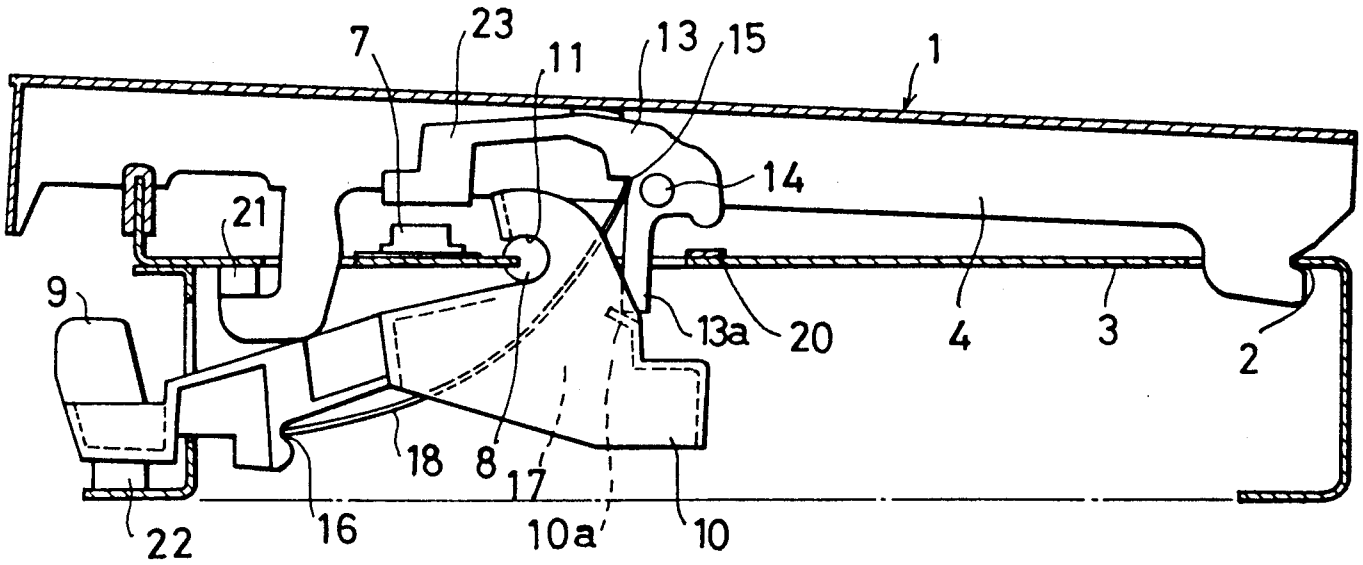
FIG. 7 is a side view, partly in section, of another embodiment of this invention in a condition in which the key is released.

FIG. 7 shows another embodiment of this invention. In FIG. 7, the jack 13 is rotatably supported, in the same manner as in the above-mentioned embodiment, by the fitting of the supporting shaft 14 with the bearing recesses of the white key 1. The hammer 10 is rotatably supported relative to the white key 1 and the keyboard chassis 3 by the engagement of the supporting shaft 8 with the bearing recess of the hammer 10. One end of the plate spring 18 is engaged with the engaging recess 16 of the hammer 10 and the other end thereof is engaged with the engaging recess 15 of the jack 13, respectively. On one end of the jack 13 there is formed an actuator 23 which actuates a keyboard switch 7 which is provided on the keyboard chassis 3. On the other end of the jack 13 there is formed the pressing portion 13*a* which abuts the hammer 10. When the key is in a released condition, the actuator 23 is oppositely positioned away from the keyboard switch 7 as shown in FIG. 7. As the keyboard switch 7, a conventional one such as a rubber switch, a photoelectric switch, a plate switch, or the like is used. This keyboard switch 7 comprises a first switch portion and a second switch portion (not illustrated) which are sequentially actuated by the depression of the actuator 23. The hammer 10 has a similar shape as that shown in FIG. 3.

Next, the operation of this embodiment will be explained. When the white key 1 in FIG. 7 is depressed, the jack 13 moves downwards until it abuts the jack stopper 20 of the keyboard chassis 3. It then rotates and consequently the pressing portion 13*a* comes out of engagement with the jack-contact portion 10*a* of the hammer 10. When the jack 13 rotates, the keyboard switch 7 is actuated by the actuator 23 of the jack 13. The actuation of this first switch portion and the second switch portion of the keyboard switch 7 is arranged to be performed sequentially by a small difference in the stroke of the key 1. When the first switch portion and the second switch portion are actuated, a sound is generated from a loud speaker in a sound volume corresponding to the time from the operation of the first switch portion to the operation of the second switch portion by a means of a known circuit.

As explained above, since this invention has in one aspect thereof the above-mentioned arrangement, it is possible for the player to obtain such a feeling of touching the key as is close to that of the acoustic piano. The number of assembling steps can be decreased and the cost can be reduced. In addition, since this invention has in another aspect thereof the above-mentioned arrangement, the sound volume which corresponds to the key depressing velocity can be stably obtained, and a good rapid successive key depression efficiency can be obtained. Further, a light-depression playing is also possible.

It is readily apparent that the above-mentioned keyboard apparatus for an electronic musical instrument has the advantage of wide commercial utility. It should be understood that the specific form of the invention hereinabove described is intended to be representative only, as certain modifications within the scope of these teachings will be apparent to those skilled in the art.

Accordingly, reference should be made to the following claims in determining the full scope of the invention.

What is claimed is:

1. A keyboard apparatus for an electronic musical instrument, comprising:

jacks and hammers, each of said jacks being rotatable by a force to be transmitted from a key when said key is depressed, each of said hammers being rotatable by a force to be transmitted onto a contact portion thereof from a pressing portion of said rotatable jack, wherein:

said respective jack is rotatably disposed relative to said respective key by fitting a first supporting shaft formed in said respective jack into a first bearing recess formed in said respective key, said respective hammer being rotatable even upon disengagement of said pressing portion of said respective jack from said contact portion of said respective hammer during rotation of said key due to depression thereof;

said respective hammer is rotatably disposed in a keyboard chassis by fitting a second supporting shaft formed in one of said keyboard chassis and said respective hammer into a second bearing recess formed in the other of said keyboard chassis and said respective hammer; and a resilient member is provided between said respective hammer and said respective jack by engaging one end and the other end of said resilient member with said hammer and said jack, respectively, such that said first supporting shaft and said first bearing recess as well as said second supporting shaft and said second bearing recess are respectively urged together and that said respective key and said respective jack are returned to their respective original positions.

2. A keyboard apparatus for an electronic musical instrument, comprising:

jacks and hammers, each of said jacks being rotatable by a force to be transmitted from a key when said key is depressed, each of said hammers being rotatable by a force to be transmitted onto a contact portion thereof from a pressing portion of said rotatable jack, said respective hammer being rotatable even upon disengagement of said pressing portion of said respective jack from said contact portion of said respective hammer during rotation of said key due to depression thereof, wherein:

said respective jack is provided with an actuator for actuating keyboard switches; and said actuator sequentially actuates a first switch portion and a second switch portion of each of said keyboard switches by the rotation of said jack.

3. A keyboard apparatus for an electronic musical instrument, comprising:

jacks and hammers, each of said jacks being rotatable by a force to be transmitted from a key when said key is depressed, each of said hammers being rotatable by a force to be transmitted onto a contact portion thereof from a pressing portion of said rotatable jack, wherein:

said respective jack is rotatably disposed relative to said respective key by fitting a first supporting shaft formed in said respective jack into a first bearing recess formed in said respective key, said first supporting shaft being vertically movable relative to said keyboard chassis;

said respective hammer is rotatably supported in said keyboard chassis by fitting a second supporting shaft formed in one of said keyboard chassis and said respective hammer into a second bearing recess formed in the other of said keyboard chassis and said respective hammer;

a resilient member is provided between said respective hammer and said respective jack by engaging one and the other end of said resilient member with said respective hammer and said respective jack; and a pressing portion of said respective jack and a jack contact portion of said respective hammer are engaged during a depression of said respective key up to an intermediate course of downward movement of said respective key, and, with further depression of said respective key, a chassis-contact portion of said respective jack abuts a jack-abutting portion of said keyboard chassis whereby, through rotation of said respective jack, the engagement between said pressing portion of said respective jack and said jack-contact portion of said respective hammer is released.

4. A keyboard apparatus for an electronic musical instrument, comprising:

jacks and hammers, each of said jacks being rotatable by a force to be transmitted from a key when said key is depressed, each of said hammers being rotatable by a force to be transmitted onto a contact portion thereof from a pressing portion of said rotatable jack, wherein:

a pressing portion of said respective jack and a jack-contact portion of said respective hammer are engaged during a depression of said respective key up to an intermediate course of downward movement of said respective key, and, with further depression of said respective key, a chassis-contact portion of said respective jack abuts a jack-abutting portion of said keyboard chassis whereby, through rotation of said respective jack, the engagement between said pressing portion of said respective jack and said jack-contact portion of said respective hammer is released;

said respective jack is provided with an actuator for actuating keyboard switches; and said actuator sequentially actuates a first switch portion and a second switch portion of each of said keyboard switches by the rotation of said respective jack.

* * * * *